United States Patent [19]

Brown et al.

[11] 4,068,910

[45] Jan. 17, 1978

[54] BUS BOARD CONNECTION APPARATUS

[75] Inventors: Arthur W. Brown, Los Angeles; Heinz E. Goetz, San Bernadino; Ronald J. Morrow; Charles H. Waldhauer, Jr., both of Los Angeles, all of Calif.

[73] Assignee: Honeywell Inc., Minneapolis, Minn.

[21] Appl. No.: 780,627

[22] Filed: Mar. 23, 1976

[51] Int. Cl.[2] ..... H01R 3/06; H01R 7/08

[52] U.S. Cl. ..... 339/18 P; 339/17 M; 339/277 R; 361/414

[58] Field of Search ..... 361/407, 414; 339/17 R, 339/17 M, 18 R, 18 B, 18 C, 18 P, 277 R

[56] References Cited

U.S. PATENT DOCUMENTS 3,927,925 12/1975 Borsuk ..... 339/17 M

FOREIGN PATENT DOCUMENTS 2,215,218 10/1973 Germany ..... 339/17 M

*Primary Examiner*—Roy Lake
*Assistant Examiner*—Neil Abrams
*Attorney, Agent, or Firm*—Charles L. Rubow

[57] ABSTRACT

Electrical connection apparatus is disclosed for achieving versatile connections between bus boards and electrical devices having conductive pins which extend through holes in the boards. Connections are achieved through transversely expansible conductive washers within the holes around the pins. Transverse expansion is caused by compression of individual washers along central axes of the holes, the compression being produced by expander means associated with the washers. Two expansible washer configurations are disclosed, one comprising spring material preformed with protuberances which are flattened to cause transverse expansion, and the other comprising a conductive elastomeric material.

16 Claims, 6 Drawing Figures

BUS BOARD CONNECTION APPARATUS

BACKGROUND OF THE INVENTION

The present invention relates generally to electrical connectors, and more specifically to connector apparatus for achieving versatile connections between bus boards having one or more layers and electrical devices having leads which extend through holes in the bus boards.

Various techniques and forms of apparatus have been devised for completing electrical connections between electrical devices and circuit boards or power supply bus boards. Many of these techniques and apparatus involve the use of holes in the circuit or bus boards through which leads of the electrical devices or device connectors can be inserted. It is, of course, known to solder the leads in place after insertion. Another known technique involves the use of deformable bushings, one of which at least partially surrounds each lead and is pressed into the surrounding hole in the circuit or bus board. Such an electrical coupling is the subject of U.S. Pat. No. 3,391,375 issued to W. D. Richards on July 2, 1968. These techniques are basically limited to single layer boards, and result in essentially permanent connections, thus complicating the process of making circuit modifications.

It has relatively recently become common to assemble electrical and electronic apparatus from circuits fabricated on printed circuit boards which are electrically coupled by means of edge card connectors. Fixed portions of the connectors are frequently mounted on a back plane or ground plane, and are provided with pins which extend through holes in the back/ground plane. Interconnections may be made between some of the pins by wrapping flexible conductors around the pins. Such interconnections are produced by certain automatic equipment designated by the trademark Wire Wrap.

A common bus board is frequently used for supplying electrical potential to predetermined pins of each of a plurality of connectors for powering circuitry on mating circuit boards. Where Wire Wrap type interconnection pins are provided, connections between predetermined pins and the back plane and/or bus board may be achieved with conductive bushings. Other pins may be insulated from the board by means of insulating bushings.

Frequently the back plane/bus board/connector assembly is produced according to a user specification by a jobber who specializes in such assembly tasks. This procedure facilitates economical and uniform production of the assemblies. However, the assemblies so produced lack versatility in that the connections between the bus board and the connectors are firmly fixed at the time of assembly, and changes can be made thereafter only with considerable difficulty. In addition, this construction technique is not readily adaptable to electrical apparatus in which multilayer bus boards are needed to supply several different electrical potentials.

The applicants have devised unique connection apparatus which permits versatile connections between electrical leads of the Wire Wrap type and multilayer bus boards. The connections may be altered in the field without special tools. Connections are easily made between any level in a multilayer bus board assembly and a pin extending through the assembly. Accordingly, many of the disadvantages of prior art electrical apparatus construction are reduced or eliminated.

SUMMARY OF THE INVENTION

The applicant's unique electrical connection apparatus basically comprises a transversely expansible conductive washer which is inserted in a hole in a bus board surrounding a pin to which it is desired to make an electrical connection. The washer is designed so that compression thereof along the central axis of the hole results in transverse expansion of the washer. The washer is compressed by expander means which includes first and second surfaces on opposite sides of the washer. The washer may be fabricated from spring material preformed with protuberant areas which are flattened to cause transverse expansion. The expander means may comprise base and driver members between which the washer is located and rotative coupler means for locking the base and driver members in a fixed axial relationship.

The primary object of this invention is to provide improved electrical connection apparatus.

It is a further object of this invention to provide easily alterable electrical connections between a bus board having holes therethrough and conductive pins extending through the holes.

A further object is to provide versatile electrical connection apparatus for completing electrical connections between a multilayer bus board assembly at any level in the assembly and conductive pins extending through holes in the assembly.

A further object is to provide improved bus board connection apparatus wherein electrical connections are achieved through transversely expansible conductive washers.

Yet a further object is to provide a unique expansible washer configuration in which an external transverse dimension is increased and an internal transverse dimension is decreased by compression of the washer along an axis transverse to the transverse dimensions.

Additional objects of the invention may be ascertained from a study of the disclosure, drawings and appended claims.

DESCRIPTION OF THE PREFERRED EMBODIMENT

Figure 1:
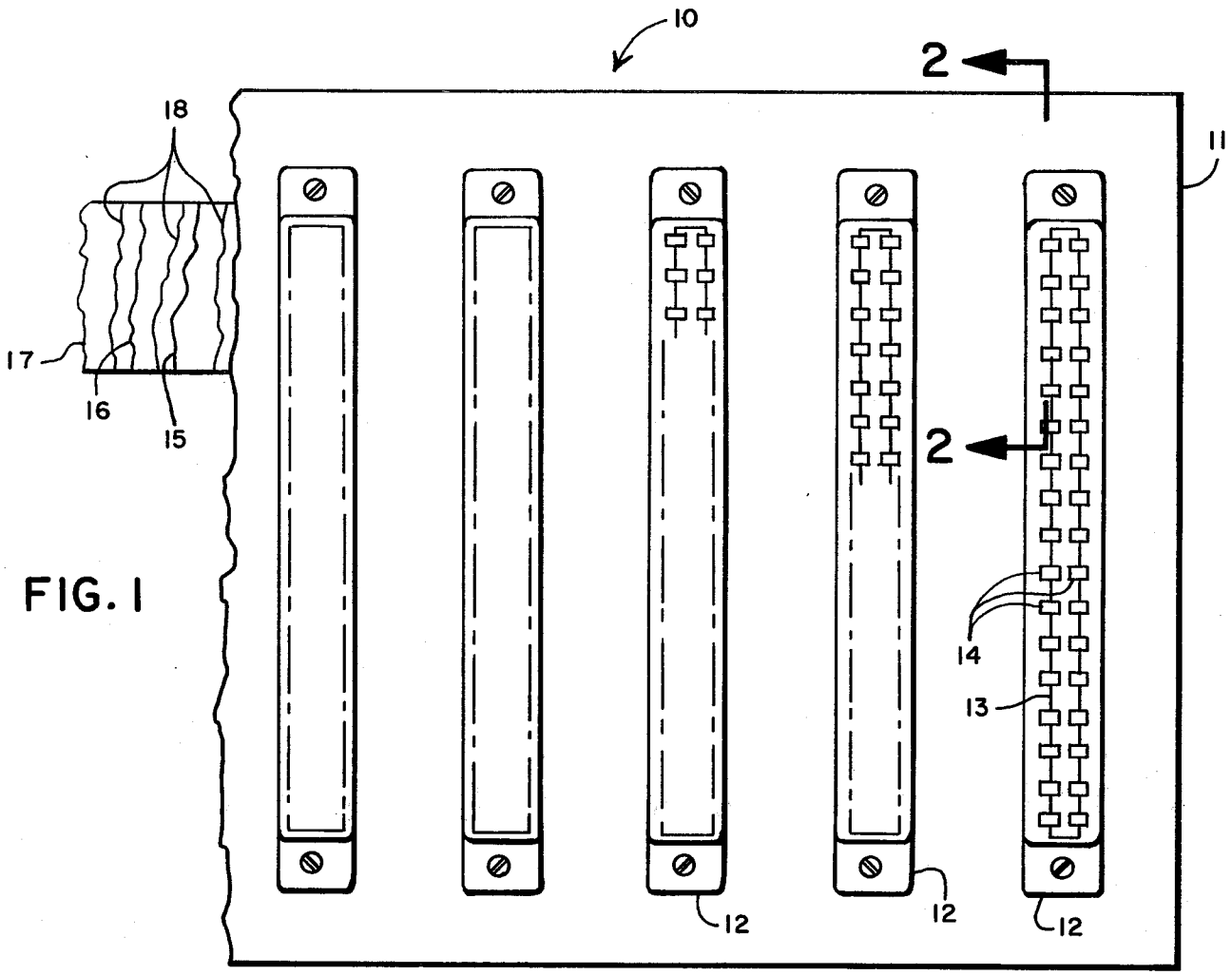
FIG. 1 is a partial illustration of a back plane assembly including a plurality of electrical circuit card edge connectors and a multilayer electrical supply bus board.

In FIG. 1, reference numeral 10 generally identifies a back plane assembly embodying various construction features common to prior art electronic apparatus. The back plane assembly includes a conductive ground plane member or board 11 on which are mounted the receptacle portions 12 of a plurality of conventional circuit card edge connectors. Ground plane member or board 11 is maintained at a zero reference electrical potential. Receptacles 12 each include a slot 13 for receiving the edge of a circuit card, and a plurality of contacts 14 for mating with contact elements along the edge of the card. A selected one or more of contact elements 14 may be connected to board 11 as will hereinafter be described. In addition, selected contact elements 14 may be connected to predetermined bus boards 15, 16 and 17 of a bus board assembly in which the bus boards are insulated from one another by insulating sheets 18.

Figure 2:
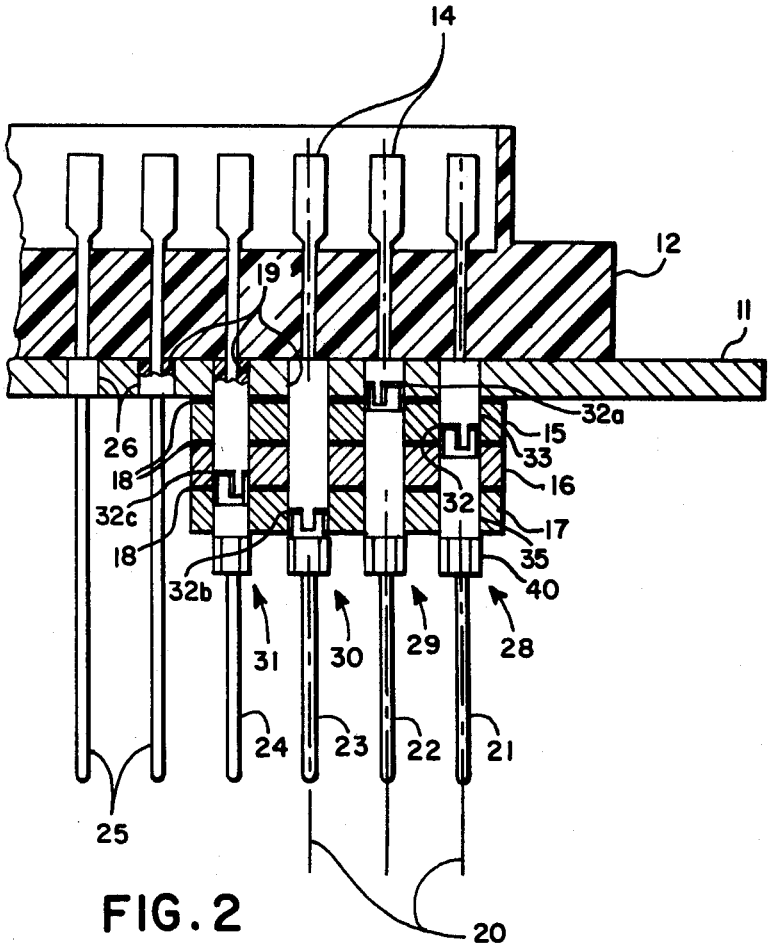
FIG. 2 is an enlarged partial cross-sectional view of the assembly of FIG. 1, illustrating use of the applicants' connection apparatus for making electrical connections between bus boards at various levels within the bus board assembly and predetermined pins on a card edge connector.

The means by which selected contact elements 14 are electrically connected to bus boards 11, 15, 16 and 17 can best be seen in FIG. 2, wherein the various elements shown in both FIGS. 1 and 2 are identified by the same reference numerals as in FIG. 1. The bus board assembly, comprising bus boards 11, 15, 16 and 17, has a plurality of holes 19 therethrough extending along axes 20 transverse to the major surface planes of the bus boards. In FIG. 2, contact elements 14 of receptacle 12 are connected to conductive pins 21–25 which extend through holes 19 along the central axes 20 thereof. Pins 21–25 are configured for Wire Wrap interconnections with the leads of other circuit components. Such pins have noncircular cross-sections with pronounced corners for insuring sound electrical connections with the leads wrapped therearound. It is common for such pins to be square in cross section.

As shown in FIG. 2, the four contact elements 14 at the right end of receptacle 12 are intended for supplying various electrical potentials to components on the circuit card associated with the receptacle. The remaining two illustrated contact elements are shown for carrying electrical signals to or from the circuit card. Bus boards 11, 15, 16 and 17 are shown of a solid conductive material. However, the boards may also be of a laminated construction in which only the outer surfaces and at least a portion of the surfaces bounding holes 19 are of a conductive material.

Pins 21–25 are associated individual contact elements 14 from right to left respectively. Pins 25, associated with the two contact elements at the left side of FIG. 2, are insulated from board 11 by means of insulating bushings 26 inserted in the holes 19 around the pins. Pins 21, 22, 23 and 24 are connected to boards 15, 11, 17 and 16 respectively through connection devices 28, 29, 30 and 31. The electrical connections are made through conductive washers **32–32*c*** as will hereinafter be described.

Figure 3:
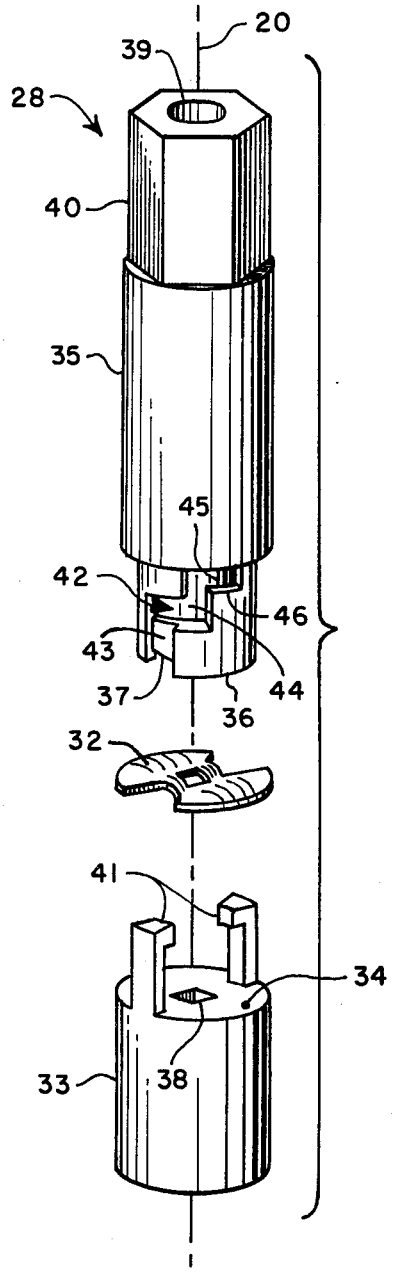
FIG. 3 is an exploded view of one embodiment of electrical connection apparatus in accordance with the applicants' invention.

For purposes of illustrating the applicants' connection device in greater detail, device 28 of FIG. 2 is shown in exploded form in FIG. 3. Washer 32 is located between a base member 33 having a first surface 34 thereon and a driver member 35 having a second surface 36 thereon. Conductive washer 32 is transversely expansible as will be further discussed in connection with FIGS. 4 and 5. Surface 36 includes a diametral channel 37 therein which permits the desired functioning of washer 32. Base and driver members 33 and 35 are preferably molded of an insulating material so as to preclude formation of undesired electrical paths.

Base member 33 and at least a portion of driver member 35 are shown with a diameter substantially equal to the diameter of holes 19, so as to fit therewithin. The base and driver members include a rotative coupler for locking the members together so as to maintain washer 32 in a compressed condition. For purposes of facilitating coupling and decoupling of base and driver members 33 and 35, base member 33 is provided with a central hole 38 configured to match the cross section of pins 21–25 so as to restrain the base member from rotation when it is in place. For illustrative purposes, and in accordance with typical Wire Wrap pin configurations, hole 38 is shown square in cross section.

Driver member 35 has a central hole 39 therethrough to accommodate a conductive pin such as pins 21–25. Driver member 35 is provided with a portion 40 which is exposed when the driver member is in place. As shown, exposed portion 40 comprises a hexagonal head to facilitate rotation of the driver member relative to the base member. The rotative coupler shown in FIG. 3 is a bayonet type coupling which includes a pair of inwardly projecting dogs 41. Dogs 41 cooperate with a pair of diametrally located stepped indentations 42 in driver member 35. Each indentation 42 includes a first shallow channel 43 near surface 36 and a second deeper channel 44 more remote from surface 36, with a small ledge between the channels. The purpose of the small ledge is to keep the several elements of connection device 28 together when the device is not in place for making an electrical connection. The portion of indentation 42 immediately adjacent the small ledge functions to accommodate one of dogs 41 when connection device 28 is in an unlocked state. Locking of the device is accomplished by rotating driver member 35 relative to base member 33 to a position where dog 41 can be moved along the deeper axial channel of indentation 42. With dog 41 at an upper position in indentation 42, as seen in FIG. 3, driver member 35 can be further rotated so that the dog is moved into a locking portion 45 of the indentation. Ledge 46 of locking portion 45 serves to maintain the base and driver members in a fixed axial relationship.

Figure 4:
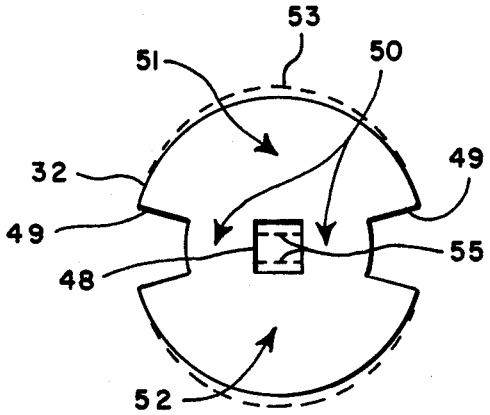
FIGS. 4 and 5 are detailed views of a transversely expansible conductive washer utilized in the connection apparatus of FIG. 3.
Figure 5:
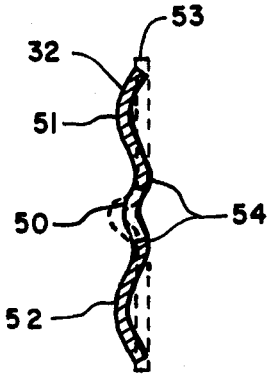

The embodiment of washer 32 illustrated in FIGS. 4 and 5 comprises one form of transversely expansible conductive washer suitable for use in the applicants' connection device. Washer 32 is fabricated of a conductive spring material, and provided with a central hole 48 configured to closely conform to the cross section of conductive pins 21–25 after the washer is preformed into its desired shape. Washer 32 is also provided with a pair of notches 49 to accommodate the axial supports for dogs 41 on base member 33.

Washer 32 is preformed to have a first protuberant area 50 substantially bisecting the washer, and second and third protuberant areas 51 and 52 located along chords on opposite sides of the first protuberant area. When washer 32 is in its relaxed condition, as shown by the solid line drawing in FIGS. 4 and 5, it has a diameter slightly smaller than the diameter of holes 19 so as to permit insertion of the washer into the holes. Base and driver members 33 and 35 are configured to compress washer 32 between surfaces 34 and 36, thereby flattening protuberant areas 51 and 52. When areas 51 and 52 are flattened, washer 32 is caused to transversely expand as indicated by dashed outline 53.

Concurrently, protuberant area 50 becomes exaggerated as permitted by channel 37 in surface 36. This effect results in part from transverse forces exerted on the edges of washer 32, and in part from resistance to straightening of the knees identified by reference numeral 54. Exaggeration of protuberant area 50 causes a decrease in a transverse dimension of hole 48 as indicated by dashed lines 55. Accordingly, with connection device 28 in place, and as washer 32 is compressed, the washer is caused to grip both the interior surface of a hole in a bus board and the exterior surface of a conductive pin within the hole so as to achieve a sound electrical connection between the board and the pin.

Figure 6:
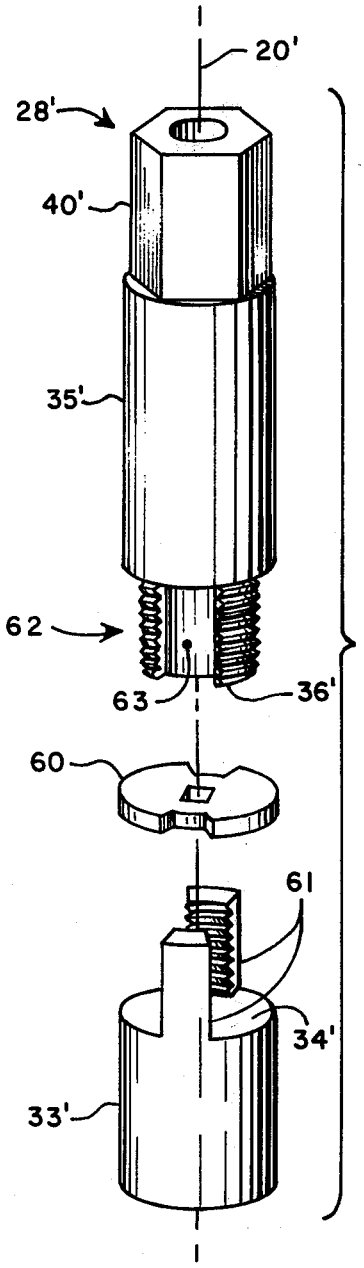
FIG. 6 is an exploded view of a second embodiment of the applicants' connection apparatus.

An alternate embodiment of the applicants' connection device is shown in FIG. 6, wherein elements similar to elements illustrated in FIG. 3 are identified by like reference numerals with a prime added. The principal differences reside in substitution of a conductive elastomeric washer for the preformed spring washer, and substitution of an interrupted thread rotative coupler for the bayonet type coupler of FIG. 3. The conductive elastomeric washer is identified by reference numeral 60. In use, washer 60 is axially compressed between surfaces 34' and 36'. This compression causes the elastomeric material to expand in directions transverse to axis 20', thereby gripping the interior surface of a hole in the bus board and the exterior surface of a conductive pin. In general, conductive elastomeric material has a higher resistance and less current carrying capacity than a similar spring washer configuration. Accordingly, connectors utilizing conductive elastomeric washers are principally useful in signal level applications in contrast to power supply applications.

The interrupted thread rotative coupler illustrated in FIG. 6 comprises a pair of axially projecting shell portions 61 on base member 33'. Shell portions 61 are formed with an internal screw thread as shown. Driver member 35' includes a coupler portion 62 of reduced diameter formed with a pair of axial channels 63 configured to permit axial passage of shell portions 61. The remaining areas of coupler portion 62 are formed with an external screw thread, whereby after base and driver members 33' and 35' are axially mated, the driver member may be rotated relative to the base member to lock the members in a fixed axial relationship, thereby accomplishing the same function performed by the bayonet coupler of FIG. 3.

As is apparent from the foregoing discussion, the level in the bus board assembly of the bus board to which it is desired to make connection determines the required axial position of the conductive washer along the pin. Appropriate positioning can be accomplished by inversely varying the relative lengths of the base and driver members of the connection device.

With reference to FIG. 2, it is desired to connect pin 22 to board 11 which occupies the closest level to connector 12. A connection device for making such a connection inlcudes a base member of minimum length and a driver member of maximum length. Conversely, it is desired to connect pin 23 to bus board 17 at the level furthest from connector 12. A connection device for making such a connection includes a base member of maximum length and a driver member of minimum length. Similarly, pins 21 and 24 are respectively connected to bus boards at intermediate levels. This can be accomplished by utilizing connection devices in which the base and driver members have correspondingly appropriate lengths.

The applicants' connection device is easily installed by first selecting a device having base and driver members of the length which will locate the washer at the level in the bus board assembly at which it is desired to make connection. The connection device is then inserted over the pin and into the hole in the assembly. After the connection device is properly seated, further axial pressure sufficient to compress the conductive washer is exerted on the driver member and the driver member rotated to lock it together with the base member. The connection device can be removed with equal ease by reversing the foregoing steps.

Accordingly, it is apparent that the applicants' connection device permits versatile electrical connections between electrical leads of the Wire Wrap type and multilayer bus boards. The connections are easily alterable and field repairable, thus providing exceptional utility. Connections and disconnections are easily accomplished at any level within a multilayer bus board. Finally, no special tools are required for installation or removal of the applicants' connection device.

Although specific embodiments of the applicants' unique electrical connection apparatus have been shown and described for illustrative purposes, other embodiments within the applicants' contemplation and teaching will be apparent to those skilled in the art. The applicants do not intend that coverage be limited to the disclosed embodiment but only by the terms of the appended claims.

The embodiments of the invention in which an exclusive property or right is claimed are defined as follows:

1. In electrical apparatus of the type including at least one bus board for supplying electrical potential to a component having a conductive pin which extends through a hole in the board along a central axis of the hole, the hole being at least partially bounded by a conductive surface, an improved connection device comprising:

a transversely expansible conductive washer sized to permit positioning thereof around the conductive pin within the hole in the bus board, compression of said washer along the axis of the hole causing transverse expansion of said washer; and expander means for compressing said washer between a pair of surfaces transverse to the axis of the hole, thereby transversely expanding said washer to achieve electrical connection between the board and the pin.

2. The connection device of claim 1 wherein said conductive washer comprises spring material preformed with protuberant areas which may be flattened to cause transverse expansion of said washer.

3. The connection device of claim 2 wherein said expander means comprises a base member and a driver member between which said washer is located, said base member and at least a portion of said driver member being sized to fit within the hole in the bus board, and each having a central hole therein to accommodate the conductive pin, said base and driver members being adapted to cooperate so that predetermined movement of said driver member relative to said base member results in axial compression of said washer.

4. The connection device of claim 3 wherein:

said conductive washer is preformed with a first protuberant area bisecting said washer and second and third protuberant areas located along chords on opposite sides of said first protuberant area; and the surfaces of said expander means are formed to flatten only the second and third protuberant areas on said washer, thereby exaggerating said first protuberant area and decreasing a transverse dimension of a central hole in said washer so as to grip the conductive pin.

5. The connection device of claim 4 wherein:

said base and driver members include rotative coupler means for locking said members in a fixed axial relationship by rotating said driver member relative to said base member;

the conductive pin has a non-circular cross section;

the central hole in said base member is configured to match the pin cross section so as to prevent rotation of said base member; and said driver member includes an exposed portion configured to facilitate rotation thereof relative to said base member.

6. The connection device of claim 5 wherein said base and driver members include a bayonet coupling for maintaining compression of said conductive washer.

7. The connection device of claim 5 wherein said base and driver members include an interrupted thread coupling for maintaining compression of said conductive washer.

8. The connection device of claim 1 wherein said conductive washer is formed of a conductive elastomeric material.

9. Electrical circuit apparatus including an improved system for supplying electrical potentials from bus boards to circuit devices through connectors having conductive pins which extend through holes in the boards along central axes of the holes, said circuit apparatus comprising:

a multilayer bus board assembly including a plurality of bus boards insulated from one another and each carrying an electrical potential, said bus board assembly having holes therethrough transverse to the planes of the boards for accepting conductive pins of electrical device connectors, the holes in each board being at least partially bounded by conductive surfaces;

a plurality of transversely expansible conductive washers, each interposed between a predetermined conductive pin and a conductive surface bounding a hole in a predetermined bus board, compression of said washers along the axes of the holes causing transverse expansion of said washers to achieve separate electrical connections between said predetermined boards and pins respectively; and expander means associated with each of said washers for compressing said washers betwen pairs of surfaces transverse to the axes of the holes to provide for transversely expanding said washers.

10. The circuit apparatus of claim 9 wherein at least one of said conductive washers comprises spring material preformed with protuberant areas which may be flattened to cause transverse expansion of said washer.

11. The circuit apparatus of claim 10 wherein:

said conductive washer is preformed with a first protuberant area bisecting said washer and second and third protuberant areas located along chords on opposite sides of said first protuberant area; and the surfaces of said expander means are formed to flatten only the second and third protuberant areas on said washer, thereby exaggerating said first protuberant area and decreasing a transverse dimension of a central hole in said washer so as to grip the conductive pin extending therethrough.

12. The circuit apparatus of claim 11 wherein said expander means comprises a base member and a driver member between which said conductive washer is located, said base member and at least a portion of said driver member being sized to fit within a hole in the bus board assembly, and each having a central hole therein to accommodate the conductive pin, said base and driver members being adapted to cooperate so that predetermined movement of said driver member relative to said base member results in axial compression of said washer.

13. The circuit apparatus of claim 12 wherein:

said base and driver members include rotative coupler means for locking said members in a fixed axial relationship by rotating said driver member relative to said base member;

the conductive pin has a noncircular cross section;

the central hole in said base member is configured to match the pin cross section so as to prevent rotation of said base member; and said driver member includes an exposed portion configured to facilitate rotation thereof relative to said base member.

14. The circuit apparatus of claim 13 wherein base and driver members include a bayonet coupling for maintaining compression of the conductive washer between said members.

15. The circuit apparatus of claim 13 wherein said base and driver members include an interrupted thread coupling for maintaining compression of the conductive washer between said members.

16. The apparatus of claim 9 wherein at least one of said conductive washers is formed of a conductive elastomeric material.

* * * * *